United States Patent [19]

Lundgren et al.

[11] 4,296,653

[45] Oct. 27, 1981

[54] METHOD AND A DEVICE FOR REMOVING CORKS FROM VESSELS

[75] Inventors: Sune I. Lundgren, Luleå; Leif E. L. Rehnberg, Boden, both of Sweden

[73] Assignee: Kemi-Intressen AB, Sundbyberg, Sweden

[21] Appl. No.: 118,803

[22] PCT Filed: Nov. 8, 1978

[86] PCT No.: PCT/SE78/00070

§ 371 Date: Jun. 20, 1979

§ 102(e) Date: Jun. 20, 1979

[87] PCT Pub. No.: WO79/00268

PCT Pub. Date: May 17, 1979

[30] Foreign Application Priority Data

Nov. 10, 1977 [SE] Sweden ..... 7712690

[51] Int. Cl.[3] ..... B67B 7/00

[52] U.S. Cl. ..... 81/3.46 R; 81/3.1 B

[58] Field of Search ..... 30/304; 81/3.1 R, 3.1 B, 81/3.3 R, 3.46 R, 3.46 A, 3.47, 3.49

[56] References Cited

U.S. PATENT DOCUMENTS

| | | | |
|---|---|---|---|
| 2,759,383 | 8/1956 | Mrazik | 81/3.46 A |
| 3,143,904 | 8/1964 | Yerkes | 81/3.46 R X |
| 4,085,632 | 4/1978 | Hogan et al. | 81/3.3 R |

FOREIGN PATENT DOCUMENTS

| | | | |
|---|---|---|---|
| 49076 | 7/1934 | Denmark | 81/3.46 R |

*Primary Examiner*—James G. Smith

*Attorney, Agent, or Firm*—Fred Philpitt

[57] ABSTRACT

A method and a device for removing corks from vessels. The device comprises a pair of knives and a holder for the knives, which holder fixes the position of the knife-edges relative to each other and with a spacing between the knife-edges, which spacing is smaller than the diameter of the cork to be removed from a vessel measured immediately above the position on the cork where it is intended to be gripped between the knives. By use of the device the cork is removed by moving the vessel with the attached cork towards the knives at a level suitable to position the portion of the cork that extends above the vessel between the knife-edges and moving the vessel away from the knives.

9 Claims, 7 Drawing Figures

METHOD AND A DEVICE FOR REMOVING CORKS FROM VESSELS

TECHNICAL FIELD

The present invention relates to a method of and a device for removing corks from vessels.

BACKGROUND ART

The invention particularly relates to the removal of corks from vessels which either contain substances that are dangerous to the health or substances which are especially susceptible to external contamination. Large quantities of vessels with this type of contents, e.g. test-tubes containing infected samples, are regularly handled at hospitals. Vessels of this kind are usually opened by hand. There is then a risk of spreading of the contents of the vessel to the environment and to other vessels via the hands and also a risk of contamination of the contents of the vessel from the environment. Use of disposable gloves lessens the risk of spreading but does instead cause a destruction problem. Corks as closure members involve a special problem as they, in the absence of particular means for holding, generally are inserted with great force and thus also require great force at extraction. Therefore it sometimes happen that the cork, glove or vessel is broken at the removal of the cork whereby of course the risk of contamination becomes acute.

There is consequently a strong need for auxiliary devices in order to reduce the risk of contamination and to simplify the procedures connected with the removal of corks from vessels of this type, but also when no particular risks of contamination exist is it desired to simplify and standardize the process of removing stoppers when large quantities of vesssels are handled, e.g. at laboratories.

DISCLOSURE OF THE INVENTION

The present invention relates to a method and a device for removing corks from vessels, such as test-tubes, bottles and similar containers, which are fitted with corks having the upper part free with respect to the opening of the vessel. By the invention a simplified procedure for removing corks and reduced risks of contamination are gained.

According to the invention a device is used including a pair of knives and a holder for the knives, which holder fixes the knife-edges in direction towards each other and with a spacing between the knife-edges, which spacing at least somewhere is smaller than the diameter of the cork to be removed from its vessel, measured immediately above the position on the cork where it is intended to be inserted between the knives.

The device is intended to be used in such a manner that the vessel with the cork is brought towards and in between the two knife-edges at such a height that one part of the free part of the cork will be positioned between the edges and that the vessel thereafter is brought away from the knives.

By using two knife-edges directed towards each other as means for holding the corks a number of advantages are gained. The device is simple and does not require any movable parts in order to grip the cork. The extracted cork can, without special measures or special devices, be carried away by the next cork which is to be removed, in that this is brought in between the knives and hereby pushes the first one out. The device can be used for greatly differing types and designs of corks, the only requirement being that the corks have a part which is free with respect to the opening of the vessel. For corks of different sizes it is only necessary to adjust the distance between the knife-edges so that this, at at least one place, becomes smaller than the circumference of the inserted cork. By this knife-design only a small part of the device will get into contact with the cork whereby also the area that might be contaminated is kept small. Removal of corks by means of the device does not require any particular skill and when the cork has been brought in between the knives the risk that it may come loose or in other ways get into contact with the environment is very small. The simplicity of the device also means that it is easy to clean. Other advantages will be evident from the discussion below.

The invention can be applied whenever a cork having a free part above the orifice of the vessel is to be removed. As has been mentioned above, it is however preferred that the invention is applied in such situations where it is particularly important to avoid contamination of the contents of the vessels or contamination of the environment by the contents of the vessels. The invention is particularly suitable for being applied when the contents of the vessels are dangerous to the health and at that particularly when they contain microorganisms as the risks of spreading of these are especially pronounced depending on the risk of growth. Vessels containing this type of samles are moreover generally fitted with tightly inserted corks of types which are difficult to remove. The device according to the invention has only small areas where contamination and growth may take place.

The device can be used for essentially all shapes of corks and thereby makes it possible to carry out a simple and reliable removal. The grasping can however be carried out somewhat different for the different kinds of corks. When the corks are cylindrical or when the shape is converging upwards above the opening of the vessel it is, in order to get a secure grip, required that the relative distance between the knives is such that they partly penetrate into the body of the cork. When the cork is diverging upwards the grasp at the insertion of the cork between the knives can be looser as the grip will become firmer when the vessel is moved downwards in order to release the cork. Most of the types of corks used for medical purposes have however not a shape which varies evenly from bottom to top but the circumference of the part which is pressed down into the vessel is smaller than that of the part just above the opening whereby the transition part is sharp and form a flange which becomes placed against the periphery of the orifice of the vessel. In these cases the grasp with the knives is advantageously made between the periphery of the orifice of the vessel and the flange of the cork. Hereby a reliable grip is obtained without the necessity of applying a great force. With a grip of this kind where the knives are in contact with the vessel it is also easy to tilt off the cork. Also in this case can, of course, if the highest degree of protection against contamination of the knives is required, the grip be made higher up on the cork as has been described above.

Essentially all types of material in the corks are acceptable when carrying out the method of the invention. When the materials are brittle, such as cork material, the risk of fracture at a too sharp and deep incision between the knives should be taken into consideration.

These corks are thus most safely removed when they have an upwards diverging shape or with a grip under a flange. Cork is however not common for medical purposes depending on its porosity. More common are harder and denser materials such as rubber and plastic materials. Rubber stoppers can on account of the elasticity of the rubber be removed by means of a deep incision which does not have to be sharp neither should be because of the thereby arising indication of fracture. Corks of plastic materials are as a rule very hard and require a sharp incision for a grip in the body of the cork, the incision does however not need to be deep. For all stoppers a reliable grasp can however be obtained beneath a flange, whereby the knives should be sharp to make penetration between the stopper and the opening of the vessel possible.

In the device the knives form lines which preferably are horizontal or almost horizontal. A minor inclination can be used to facilitate transporting the corks away or for other practical reasons, e.g. to get a better angle for working by making it possible to incline the bottom of the vessel somewhat in the direction of the operator.

In the device the surfaces of the knives form planes which either may be overlapping or form an angle with each other. The latter arrangement can be used to bring a larger area in contact with the cork and thus obtain a less sharp grip. An arrangement with knives at an angle can also be used under a flange if this is conical instead of flat. In both cases the inclination of the knives may diverge upwards or converge upwards. The flanges are however generally flat and form a surface at right angle to the center axis of the cork and, as besides a grasp with overlapping planes of the knives requires the smallest force of application an arrangement with the knives in the same plane is preferred.

The two knife-edges may either be parallel or form an angle. A wide angle between the edges can be used to make the device suitable for different sizes of corks. The possibility to insert the cork at one side of the length of the knives and remove it at the other side is however lost in this case. It is consequently preferred that the knife-edges are parallel or almost parallel, whereby care should be taken that the distance between them at no point is substantially smaller than the diameter of the cork where the grasp is made. Within these limits a slight divergence from the entrance side is preferred in order to facilitate release of the cork at the exit side.

For a sharp grasp according to what has been said above the thickness of the edge should be less than 0.5 mm and preferably less than 0.1 mm. For a blunt grasp the thickness of the edge should be between 0.5 and 2 mm. As has been indicated above a sharp edge is preferred for a grasp under a flange and for a grasp in hard plastic corks, while blunt edges are preferred for grasping the bodies of softer corks. The thickness of the edge may vary along the length of the edge. Particularly at gripping under a flange it is preferred that the edge is sharp at the inlet between the knives and that the edge-thickness then increases towards the outlet so that the cork will be automatically removed from the vessel when this is transported from the inlet to the outlet. In this case the edge-thickness at the outlet can be greater than the thickness for a blunt edge as above and is instead determined from the desired lifting height for releasing the cork. This design of the edges is particularly preferred for hard corks as they are most easily removed in this manner.

The knife-length required to obtain a grip is not long but can for circular corks be restricted to half the cork-diameter. For practical reasons, particularly in order to efficiently arrange for catching the removed corks, the knife-length should, however, not be less than one cork-diameter and the length is preferably one to three cork-diameters.

The knives can be made of metal to obtain the highest degree of durability, but they can also be made of plastic material. A design in plastic material has the advantage that the knives and parts of the holding device can be made in one piece, which lessens the production costs and facilitates cleaning. For metal knives some kind of joint, e.g. a screw joint, is generally required for connecting them with the holding device, and this joint can either be made rigid to obtain the highest degree of measure fit or variable so that the distance between the knives can be adjusted to different cork sizes.

The holding device required according to the invention shall at least serve the purpose of fixing the knives relative to each other and thus comprises a holder for the knives. Although it is possible to use the device portably, e.g. by operating the device with one hand and the vessel with the other hand, the greatest advantages with respect to handling and safety are gained if the device is arranged fixedly in relation to a foundation. Thus it is preferred that the hodling device also comprises a stand, which is equipped with a foot or other means for placing it on and fixing it to a foundation, and on which stand the knife-holder is fitted, preferably in a removable and replaceable manner to facilitate cleaning and to enable the stand to be fitted with different knife-holders for different contemplated types of corks.

The knife-holder consists of a knife connecting part fixing these with respect to each other and which is extended in such a way that the corks can pass between the knives. The knife-holder can also serve additional purposes. The knife-holder is preferably equppped with a spacer arranged above the plane of the knives and having a distance to the plane of the knives adjusted with respect to the shape of the cork in such a manner that if the upper side of the cork is placed in contact with the spacer the knives will grip at the desired height on the cork. It is particularly suitable to arrange such a spacer when the grasp is made under a flange just above the orifice of the vessel since this requires a careful positioning of the knives. The spacer is preferably designed as a ceiling along the entire knife-length and having a width at least corresponding to the width of the upper side of the cork. To obtain a side-positioning of the cork in a corresponding manner, side-aligning means can be arranged above each knife and the cork can at insertion between the knives be brought into contact with these to obtain a correct centering between the knives. The means for side-positioning are preferably designed as sides above and along the knives with a shape corresponding to the side projection of the cork so that the sides together with the ceiling described above form a channel through which the cork is transported in contact with the channel on three sides. The sides and the ceiling in this construction thus form the part connecting the knives as the knives are arranged below the side walls. An arrangement of this type lessens the risk of faulty handling.

The knife-holder can comprise a connecting part for just one pair of knives or it may comprise connecting parts for several different types of corks. A suitable way of producing a knife-holder of this kind is to start from a plate having a greater thickness than the free part of the cork which is intended to be removed and in this plate mill grooves with a profile corresponding to the projection of the cork above the grip of the knives whereby the groove suitably is given a rounded-off end-part which forces the cork out of this. The piece of material behind the end of the groove can then be extended to form a stand or be fitted with a connection piece for adjoining it to a separate stand. The knives are then fixed under the groove with a penetration into the groove corresponding to the desired depth of penetration into the cork. Grooves in a plate can in this way be made for example in metal or in plastic materials. A similar structure can, with or without knives, be cast in one piece, preferably in plastic material. Plates of this kind can on their outer sides be provided with grooves or protruding parts or other means of joining so that they can be connected forming assemblies for the types of corks most frequently used at the moment.

Since the invention is intended particularly as an auxiliary means when handling vessels with health-endangering contents it is suitable to arrange, in connection with the knives, means for collecting the removed corks in order to take care of these in a reliable manner. This can be achieved by arranging a funnel, the opening of which covers the part behind the knives and preferably also the last part of the length of the knives so that the corks are safely collected in the funnel. The funnel should be attached to the knife-holder in such a manner that its periphery is tightly placed against this, except forwards, towards the knives, where it forms a slit as the brim of the funnel is positioned so low that the corks can pass over it. The brim should however not be placed so low that the vessel can be moved past the same but should preferably be placed so high up that it forms a stop for the vessel when the cork is brought in between the knives. The stop should be at a point suitable for removal of the cork from the vessel, e.g. at a distance corresponding to at least one cork-diameter from the inlet of the knives. Also when a funnel is not used it can be suitable to provide the device with a similar stop for the vessel, e.g. in the form of a loop beneath the knives. The funnel or the collecting device can end up in a collecting container for the corks which may contain a disinfectant liquid or another agent for rendering the substance of the vessel harmless.

The device can advantageously be equipped with means for air suction connected to the area with the knives for removing formed drops, particles or gases. In test-tubes fitted with corks there is often a slight negative or positive pressure why tiny droplets or splashes of the contents may be formed at opening the tube. Drops which reach the environment may also be formed by splash in the vessels and when the corks fall down in the collecting device. The air suction is suitably connected to the funnel, if such one is used, as hereby is achieved both a suction in the funnel exactly where the corks are released and a hindrance to the contents of the collecting container for moving out through the slit.

The device is simple to handle and no particular practice is required for being able to utilize it efficiently. The cork of the vessel is brought in between the knives by eye if means for positioning are absent, or if such are present the body of the cork is simply brought into contact with these whereby the fit will be good also with a rough positioning. The vessel with the cork is thereafter pushed in so that at least a free part of the knives can be discerned in front of the cork, but preferably it is pushed in to a predecided stop according to what has been said above. In those cases where the cork has been released hereby by a wedge-type edge of the knives, the vessel can now be brought downwards away from the cork. In other cases the vessel should not be pulled downwards with great force before it has come loose, but instead be set free by some lateral or rotating movements with respect to the knives and then be removed downwards. When the following cork in the same manner is inserted between the knives, the first one is without any additional measures pushed away towards the outlet of the knives and falls, optionally after insertion of still another cork, down from the space between the knives and can be collected.

BRIEF DESCRIPTION OF DRAWINGS

Some particularly preferred embodiments will be described below with reference to the accompanying drawings.

Figure 2:
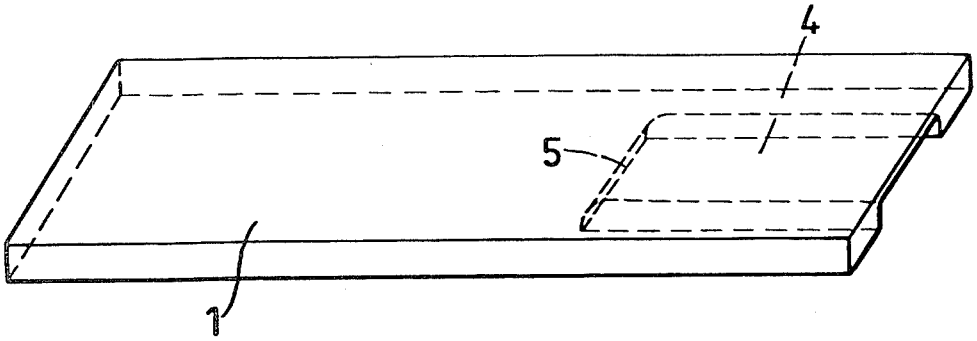
Figure 3:
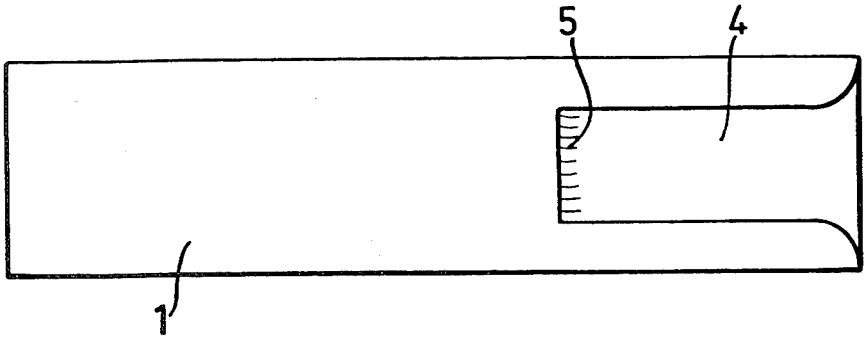
Figure 4:
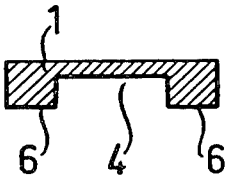

The FIGS. 2, 3 and 4 show an alternative knife-holder plate with grooves for one type of cork.

Figure 5:
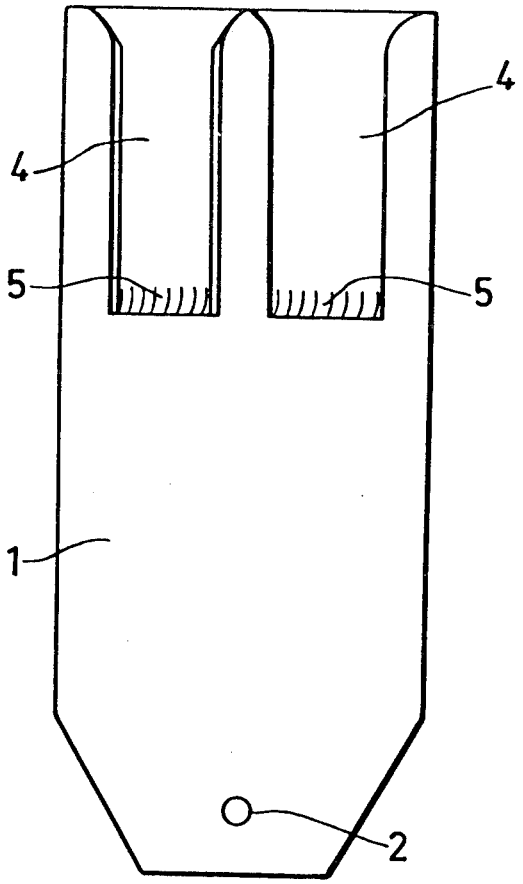
Figure 7:
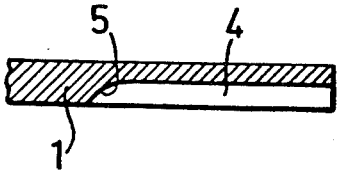
Figure 6:
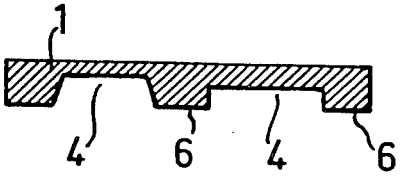

The FIGS. 5, 6 and 7 show another knife-holder plate with grooves for two different types of corks. Corresponding details have been given the same designations in all the figures.

Figure 1:
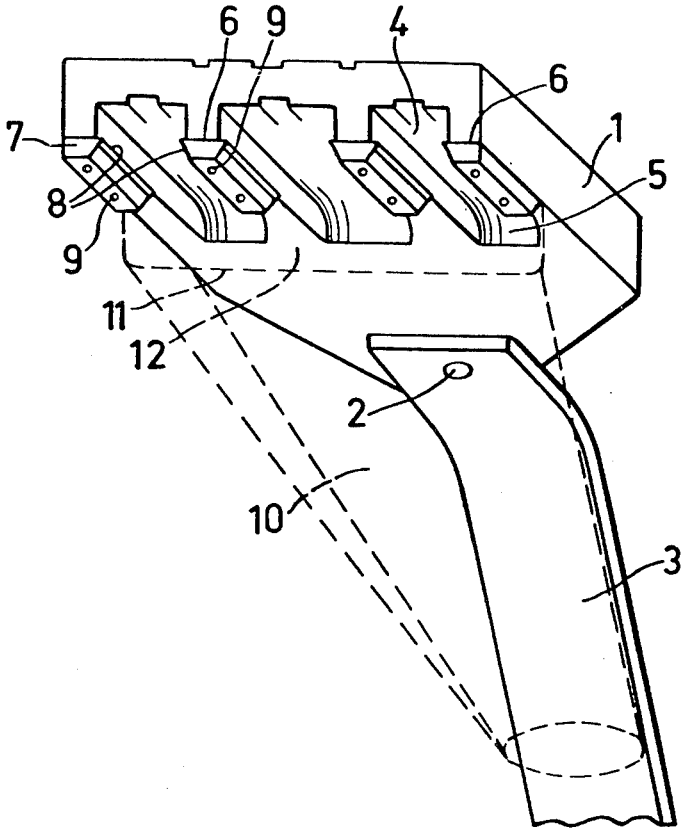
In FIG. 1 is shown a view of the device.

In FIG. 1 position 1 designates a knife-holder plate which via a connecting piece 2 is connected with a schematically shown stand 3. The knife-holder 1 is provided with three grooves 4, which correspond to the free part of three different types of cork. The grooves end in rounded-off parts 5. On the under-side 6 of the sides of the grooves 4 knives 7 with edges 8 are fastened by screws 9. Below the knife-holder 1 a collecting funnel 10 is indicated with broken lines. The funnel 10 is tightly placed against the knife-holder 1 except at the front where the brim 11 is free in relation to the knife-holder 1, in such a manner that a slit 12 is formed.

The FIGS. 2, 3 and 4 are views from below and in section of a knife-holder plate with a groove 4 but without showing the knives. As is evident from FIG. 3 the opening 4 has been given a rounded inlet to facilitate insertion of the cork.

The FIGS. 5, 6 and 7 show from below, in cross section and side section respectively, an alternative knife-holder plate with two grooves 4 for different types of corks. As is evident from FIG. 6 the left groove 4 has been adjusted to a type of cork which has an upwards converging conical shape which furthermore is higher than the cork for which the right groove 4 has been adjusted and which is assumed to have a cylindrical free part.

We claim:

1. A method for removing corks from vessels, such as test tubes, bottles and similar containers where the upper part of the cork extends above the orifice of the vessel, comprising the steps of (a) bringing the vessel with the cork in a first horizontal direction towards the inlet side of two elongated and generally parallel knife-edges that are disposed in the same horizontal plane at a height suitable to let a portion of the cork that extends out of the vessel to come into engagement between the knife-edges, (b) separating the vessel from the cork and the knife-edges by moving the vessel in a vertically downward direction that is substantially perpendicular to said first horizontal direction, and (c) separating the cork from the engagement between the knife edges by moving the cork further in said first horizontal direction towards the outlet side of said two substantially parallel knife-edges.

2. A method according to claim 1, in which the cork engaged between the knife edges after removal of the vessel, is removed from the spacing between said two substantially parallel knife edges by bringing a second cork in between the inlet side of said edges in the same first horizontal direction.

3. A device for removing corks from vessels in situations when the upper part of the cork extends above the orifice of the vessel, which device comprises two elongated knives, each equipped with a knive-edge, and a holding device which supports the knives in a spaced apart relationship in the same horizontal plane and fixes the knives with their knive-edges oriented substantially parallel to each other in the same horizontal plane, directed towards each other and separated by a distance less than the largest diameter of the cork to be removed, said holding device having an inlet opening and an outlet opening and being elongated so as to form a free space which allows linear passage of a cork from said inlet opening to said outlet opening between the substantially parallel spaced apart knife-edges.

4. A device according to claim 3, in which the horizontal distance between the knife edges at least somewhere is smaller than the inner diameter of the orifice of the vessel.

5. A device according to claim 3 in which the thickness of the knife-edges increases along their edge-length.

6. A device according to claim 3 in which the holding device for the knives is equipped with a space above the horizontal plane of the knife-edges so that if the top side of the cork is placed against the top of this space the knife edges will grip the cork immediately above the orifice of the vessel.

7. A device according to claim 6 in which said space functions as a ceiling above and parallel with the horizontal plane of the knife edges and has a width at least corresponding to the width of the top side of the cork and in that from the ceiling sides extend downwardly, such sides having a shape adjusted with respect to the side-projection of the cork whereby an elongated channel, open on the underside, is formed through which channel the cork can be transported surrounded thereby on three sides.

8. A device according to claim 3 in which a collecting funnel for the corks is arranged with its opening under the plane of the knives and at a distance from this which allows passage of the entire cork over the brim of the funnel and arranged so that the opening of the funnel covers at least the area immediately behind the outlet end of said knives.

9. A device according to claim 8 in which means for air suction is arranged in connection with the knife area.

* * * * *